US008307810B2

(12) United States Patent
Haas et al.

(10) Patent No.: US 8,307,810 B2
(45) Date of Patent: Nov. 13, 2012

(54) SYSTEM AND METHOD FOR PREVENTING OVERHEATING OF A FUEL PUMP

(75) Inventors: Stefan Haas, Quarnbek / OT Flemhude (DE); Bert Ritscher, Altenholz (DE); Bodo Gneist, Dessau-Rossiau (DE); Horst Ressel, Leutenbach (DE); Wolfgang Scheibe, Ludwigsburg-Poppenweiler (DE); Jürgen Schick, Waldenbuch (DE)

(73) Assignees: Caterpillar Motoren GmbH & Co. KG, Kiel (DE); L'Orange GmbH, Stuttgart (DE)

( * ) Notice: Subject to any disclaimer, the term of this patent is extended or adjusted under 35 U.S.C. 154(b) by 127 days.

(21) Appl. No.: 12/864,861

(22) PCT Filed: Nov. 28, 2008

(86) PCT No.: PCT/EP2008/010125

§ 371 (c)(1),
(2), (4) Date: Oct. 19, 2010

(87) PCT Pub. No.: WO2009/095053

PCT Pub. Date: Aug. 6, 2009

(65) Prior Publication Data

US 2011/0023830 A1 Feb. 3, 2011

(30) Foreign Application Priority Data

Jan. 31, 2008 (EP) ..... 08001853

(51) Int. Cl.
*F02M 37/08* (2006.01)
*F02M 37/04* (2006.01)

(52) U.S. Cl. ..... 123/497; 123/457

(58) Field of Classification Search ..... 123/495, 123/497, 456, 447, 446, 498, 499, 500, 457; 701/103

See application file for complete search history.

(56) References Cited

U.S. PATENT DOCUMENTS 4,726,335 A 2/1988 Brauninger (Continued)

FOREIGN PATENT DOCUMENTS

DE 3422829 A1 1/1986

(Continued)

OTHER PUBLICATIONS

Extended European Search Report for Priority European Patent Application No. 08 001 853.

(Continued)

*Primary Examiner* — Mahmoud Gimie

(74) *Attorney, Agent, or Firm* — J-TEK Law PLLC; Jeffrey D. Tekanic

(57) ABSTRACT

A fuel injection system supplies fuel at high pressure to an internal combustion engine via at least two high-pressure fuel pumps and a high-pressure fuel distribution line. The high-pressure fuel pumps can operate in a first pump mode and a second pump mode, which differ in the amount of fuel that is pumped. A control unit alternately operates the high-pressure fuel pumps such that, during a first time period, at least one of the high-pressure fuel pumps is operated in the first pump mode and all other high-pressure fuel pumps are simultaneously operated in the second pump mode and such that, during a second time period, at least one of the high-pressure fuel pumps, which was operated in the second pump mode during the first time period, is operated in the first pump mode and the remaining high-pressure fuel pumps are simultaneously operated in the second pump mode.

25 Claims, 5 Drawing Sheets

U.S. PATENT DOCUMENTS

| | | | | |
|---|---|---|---|---|
| 5,201,294 | A * | 4/1993 | Osuka | 123/458 |
| 5,357,929 | A * | 10/1994 | McCandless | 123/446 |
| 5,771,864 | A * | 6/1998 | Morishita et al. | 123/456 |
| 6,095,118 | A * | 8/2000 | Klinger et al. | 123/446 |
| 6,823,844 | B2 * | 11/2004 | Steinbrenner et al. | 123/446 |
| 2004/0154594 | A1 | 8/2004 | Miyashita | |
| 2004/0249555 | A1 | 12/2004 | Doelker | |
| 2008/0115770 | A1 * | 5/2008 | Merchant | 123/508 |
| 2008/0127942 | A1 * | 6/2008 | Kaneko | 123/456 |

FOREIGN PATENT DOCUMENTS

| | | | |
|---|---|---|---|
| DE | 19501475 | A1 | 7/1996 |
| DE | 10335698 | A1 | 2/2005 |
| EP | 0204981 | A2 | 12/1986 |
| EP | 1167731 | B1 | 12/2004 |
| JP | 3-74564 | A | 3/1991 |
| WO | 2005106239 | A1 | 11/2005 |
| WO | 2007135545 | A1 | 11/2007 |

OTHER PUBLICATIONS

International Search Report for parent PCT Application No. PCT/EP2008/010125.

International Preliminary Examination Report for parent PCT Application No. PCT/EP2008/010125.

* cited by examiner

SYSTEM AND METHOD FOR PREVENTING OVERHEATING OF A FUEL PUMP

CROSS-REFERENCE

This application is the U.S. national stage of International Application No. PCT/EP2008/010125 filed on Nov. 28, 2008, which claims priority to European patent application no. 08 001 853.4 filed on Jan. 31, 2008.

TECHNICAL FIELD

The present disclosure refers to a fuel injection system, in particular but not exclusively to a method for controlling two or more high-pressure fuel pumps for pumping fuel having a high pressure into a high-pressure fuel distribution line system.

BACKGROUND

Conventional fuel injection systems for internal combustion engines may include one high-pressure fuel pump for supplying a predetermined amount of fuel at a high pressure to injection nozzles within a fuel injection system. Depending on the type of engine and its rated power, more than one high-pressure fuel pump may be provided for delivering a sufficient amount of fuel at a high pressure to the engine, in particular a diesel engine, operating at a desired load.

The high-pressure fuel pumps may be driven directly by the internal combustion engine. In such an arrangement it may not be possible to shut-off the fuel pumps during operation. However, the amount of fuel supplied to the pumping elements of the fuel pumps can be adjusted via flow control valves. An engine control module (ECM), or more generally a control unit, may be provided for controlling the flow control valves.

It is known that a high-pressure fuel pump may have a pumping unit or several pumping elements in which fuel leakage can occur. Fuel leakage may occur for example in a piston pump between a piston and a piston guide. The fuel leaked from the pumping element will not be pumped into the high-pressure distribution line system. Typically, the fuel leaking from the pumping element and not being pumped is recycled to an intake section of the high-pressure fuel pump. Due to the recycling of the fuel leaked from the pumping element, heat is generated in accordance with the pressure and the amount of fuel leaked from the pumping element, which heats the fuel and the parts of the high-pressure fuel pump that are contacted by or are near this fuel.

As long as a high-pressure fuel pump pumps a sufficient amount of fuel for operating the internal combustion engine in a normal pump mode, the heating may not actually cause a problem because, in addition to the heated, leaked fuel, new fuel having a lower temperature is supplied from a fuel tank, such that the mixture of the leaked fuel and the new fuel will have a temperature below a critical limit. However, the situation may become critical if the internal combustion engine is operated at an idling speed or at a low load with a corresponding low fuel consumption for too long of a time period. In this case, the ratio between the leaked fuel and the amount of new fuel supplied is relatively large and, consequently, the temperature of this mixture may rise. Further, the temperature of the parts of the high-pressure fuel pump contacted by this mixture will increase, because the portion of fuel leaked from the pumping element is relatively high in comparison to the portion of the new fuel from the tank having the lower temperature. Consequently, parts of the high-pressure fuel pump may heat up to a temperature at which damage can occur.

In DE 195 01 475 A1 a fuel injection system for an internal combustion engine comprises one fuel pump. It is stated that the heating of fuel in such a fuel injection system might be a problem. In this disclosure, the fuel pump is driven by the internal combustion engine. For avoiding an undesired heating of fuel within the fuel injection system, it is proposed to provide a coupling between the internal combustion engine and the fuel pump. A control unit is connected with the coupling such that, upon actuating, the coupling pressure generated by the fuel pump can be adjusted to the injection pressure. It is indicated that the disclosed arrangement eliminates an undesired heating of the fuel in the section of the pressure piping leading to the injection valves, because the energy supplied by the internal combustion engine for the fuel pump is only used as necessary for generating the necessary injection pressure. The remaining energy is dissipated into the coupling. This known arrangement requires a coupling and a control unit for such a coupling.

In EP 1 167 731 A2 a method for monitoring the operation of the pump function for vehicles having at least two electrical fuel pumps is disclosed. It is mentioned therein that, in case one of the fuel pumps fails, the other fuel pump may pump an amount of fuel up to a maximum. However, if the internal combustion engine should be operated at full load, a pressure drop may occur at the working fuel pump. Consequently, a temperature increase may occur, which in turn might damage parts, e.g. the catalytic converter or the exhaust manifold. For this reason, a method for monitoring the operation of the pumps is proposed in which the fuel pumps are alternatively operated. The output rate of each fuel pump is determined and compared with set-points. An operational point for the engine is selected, at which the power of the selected, active fuel pump is just sufficient to supply the engine fuel demand. Thus, this method can identify a faulty fuel pump, i.e. by determining that its output rate is lower than a corresponding set-point. Therefore, this known method does not avoid an increase of temperature, but rather it stops a faulty fuel pump from operating and possible being damaged.

For the sake of completeness, the following documents are mentioned. EP 0 204 981 A2 (corresponding to U.S. Pat. No. 4,726,335) refers to an arrangement including two fuel pumps. In a first operation mode, both fuel pumps supply fuel. In a second operation mode, only one of these fuel pumps is supplying fuel, the other fuel pump is turned off. Which fuel pump is being turned off is randomly selected. In a third pump operation, both pumps are being driven in a reverse direction to suck fuel instead of supplying fuel.

WO 2005/106239 A1 refers to a fuel supply apparatus for an internal combustion engine including two low-pressure pumps and one high-pressure pump. In a first operation mode, the first low-pressure pump is activated, the second low-pressure pump is not activated. The first operation mode is chosen in case fuel is supplied solely by the low-pressure fuel supply means. Accordingly, in the first operation mode the high-pressure pump is also turned off. In a second operation mode, the first and second low-pressure pumps are not driven, but the high-pressure pump is supplying fuel. Due to this arrangement pulsation generated from the high-pressure pump should not propagate to the low-pressure fuel system.

JP 03-074564 refers to a fuel supply system including two fuel pumps. These pumps are driven alternately to prevent discharge of vapor in the fuel.

Finally, WO 2007/135545 A1 refers to a fuel pump system adapted to be used for different kind of fuels.

The present disclosure is directed to overcoming or alleviating one or more of the problems set forth above.

SUMMARY OF THE INVENTION

According to one exemplary aspect of the present disclosure, a fuel injection system for supplying fuel at a high-pressure to an internal combustion engine may comprise at least two high-pressure fuel pumps, each high-pressure fuel pump being configured to pump fuel at a high pressure into a high-pressure fuel distribution line system fluidly communicating with the internal combustion engine. Each of the high-pressure fuel pumps is configured to be operated in a first pump mode and a second pump mode, such that in the first pump mode a first amount of fuel is pumped by the respective high-pressure fuel pump, and in the second pump mode a second amount of fuel is pumped by the respective high-pressure fuel pump. Said second amount of fuel may be greater than the first amount of fuel, wherein the total amount of fuel simultaneously pumped by all high-pressure fuel pumps may correspond to an amount of fuel that is necessary to operate the internal combustion engine at a predetermined engine load. The fuel injection system may further comprise a control unit configured to alternately operate the high-pressure fuel pumps such that, during a first time period at least one of the high-pressure fuel pumps is operated in the first pump mode and the remaining high-pressure fuel pumps are simultaneously operated in the second pump mode, and such that during a second time period at least one of the high-pressure fuel pumps, which were operated in the first time period in the second pump mode, is operated in the first pump mode and the remaining high-pressure fuel pumps are simultaneously operated in the second pump mode.

According to another aspect of the present disclosure, a method for controlling at least two high-pressure fuel pumps, said high-pressure fuel pumps being configured to supply high-pressure fuel in parallel from a fuel reservoir to a common rail fluidly communicating with an internal combustion engine, may comprise operating for a first time period at least one of said high-pressure fuel pumps in a first pump mode and simultaneously operating the remaining high-pressure fuel pumps in a second pump mode, wherein a greater amount of fuel is pumped to the common rail in the second pump mode than in the first pump mode, and subsequently operating for a second time period at least one of the high-pressure fuel pumps, which were operated in the first time period in the second pump mode, in the first pump mode and simultaneously operating the remaining high-pressure fuel pumps in the second pump mode. In the first time period and in the second time period the total amount of fuel simultaneously pumped by all high-pressure fuel pumps may correspond to an amount of fuel that is necessary to operate the internal combustion engine at a predetermined engine load, preferably when the engine is idling.

Furthermore, according to another exemplary embodiment of the present disclosure, a control unit for a fuel injection system for supplying fuel at a high-pressure to an internal combustion engine is provided. The fuel injection system for which the control unit is configured may comprise at least two high-pressure pressure fuel pumps for pumping fuel at a high pressure into a high-pressure fuel distribution line system fluidly communicating with the internal combustion engine. Each of the high-pressure fuel pumps is configured to be operated in a first pump mode and a second pump mode, such that in the first pump mode a first amount of fuel is pumped, and in the second pump mode a second amount of fuel is pumped. The control unit may be configured to alternately operate the high-pressure fuel pumps such that, during a first time period at least one of the high-pressure fuel pumps is operated in the first pump mode and all other high-pressure pressure fuel pump are simultaneously operated in the second pump mode, and such that during a second time period at least one of the high-pressure fuel pumps, which were operated in the first time period in the second pump mode, is operated in the first pump mode and all other high-pressure fuel pumps are simultaneously operated in the second pump mode. The alternately operation of the high-pressure fuel pumps may be only selected in case that the internal combustion engine is to be operated at or below a predetermined engine load, preferably when the internal combustion engine is idling.

According to another aspect of the present disclosure, a fuel injection system may comprise at least two high-pressure fuel pumps operating in parallel to pump fuel supplied from a fuel reservoir to a common rail configured to supply fuel to a plurality of fuel injectors of an internal combustion engine, wherein each high-pressure fuel pump is provided with a flow control valve configured to adjust an amount of fuel supplied from the fuel reservoir to the respective high-pressure fuel pump. The disclosed fuel injection may further comprise a control unit configured to control the operation of the flow control valves such that, when an actual load of the internal combustion engine is at or below a predetermined load threshold, the high-pressure fuel pumps are alternately operated in a first mode for a first time period and a second mode for a second time period. In the first mode at least one high-pressure fuel pump may receive a low amount of fuel supplied from the fuel reservoir while each other high-pressure fuel pump receives a relatively larger amount of fuel supplied from the fuel reservoir, and in the second mode at least one of the high-pressure fuel pumps, which were operated in the first time period in the second mode, receives a low amount of fuel supplied from the fuel reservoir while all other high-pressure pressure fuel pumps receive a relatively larger amount of fuel supplied from the fuel reservoir.

According to another aspect of the present disclosure, a method for controlling the amount of fuel pumped by at least two high-pressure fuel pumps operating in parallel to pump fuel supplied from a fuel reservoir to a common rail configured to supply fuel to a plurality of fuel injectors of an internal combustion engine, wherein each of the high-pressure fuel pumps has attached a flow control valve configured to supply fuel from the fuel reservoir to the respective high-pressure fuel pump, may comprise adjusting the flow control valves such that, when an actual load of the internal combustion engine is at or below a predetermined load threshold, the high-pressure fuel pumps are alternately operated in a first mode and a second mode. In the first mode at least one high-pressure fuel pump receives a low amount of fuel supplied from the fuel reservoir while the remaining high-pressure fuel pumps receive a relatively larger amount of fuel supplied from the fuel reservoir. In the second mode at least one of the high-pressure fuel pumps, which were operated in the second mode, receives a low amount of fuel supplied from the fuel reservoir while all other high-pressure fuel pumps receive a relatively larger amount of fuel supplied from the fuel reservoir.

According to another aspect of the present disclosure, a computer program comprises executable instructions to perform the method steps of the above-identified methods.

Finally, according to another aspect of the present disclosure, a control unit for a generatorset or a vehicle as, e.g. a ship or vessel, may have a computer program as disclosed above stored therein and a processor configured to execute said computer program.

It is to be understood that both the foregoing general description and the following detailed description are exemplary and explanatory only and are not restrictive of the disclosure.

Other features and aspects of this disclosure will be apparent to the skilled person based upon the following description, the accompanying drawings and the attached claims.

DETAILED DESCRIPTION

Figure 1:
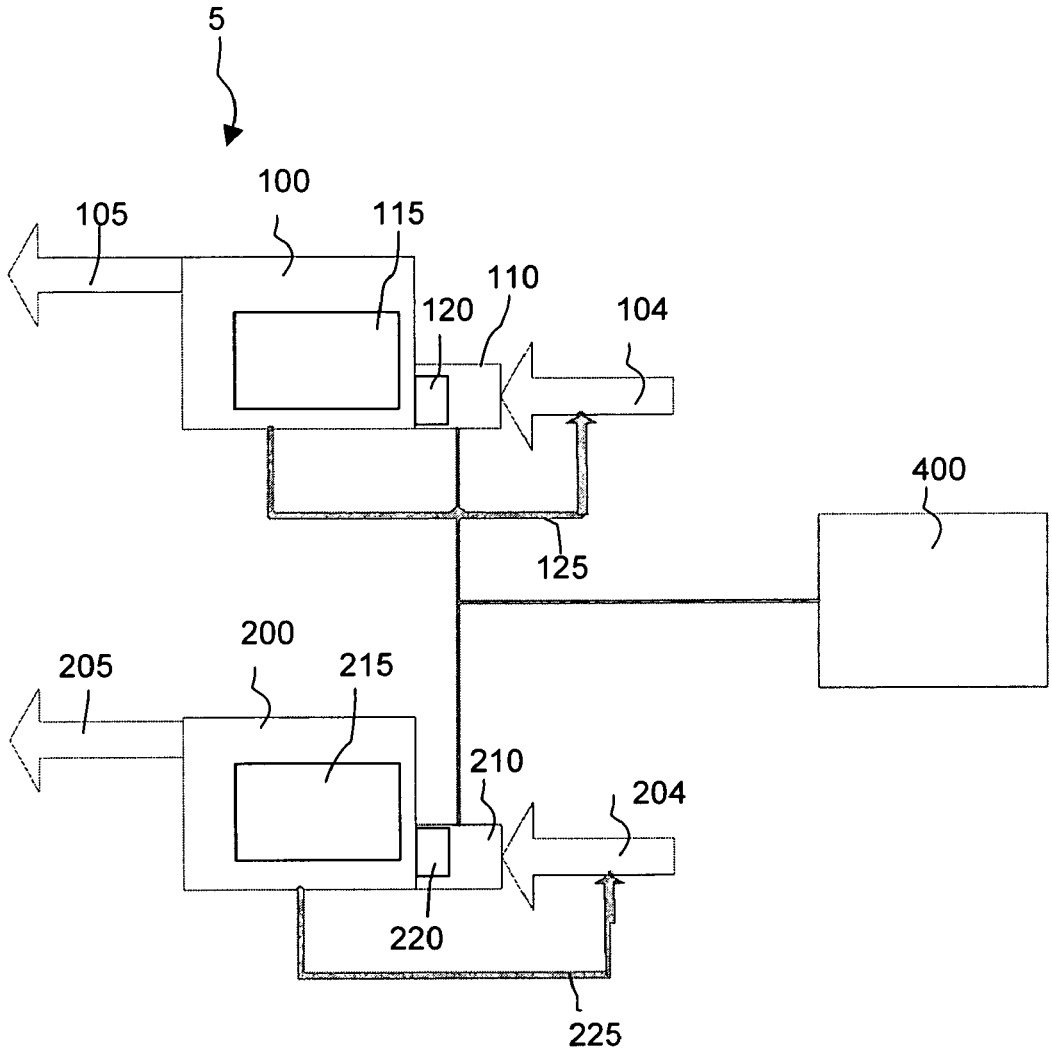
FIG. 1 is a schematic block diagram of an exemplary embodiment of a fuel injection system for supplying fuel at a high-pressure to an internal combustion engine.

With regard to FIGS. 1 and 2, a first exemplary embodiment of a fuel injection system 5 for supplying fuel 105, 205 at a high-pressure to an internal combustion engine 500 will be described. Herein, the fuel injection system 5 includes a first high-pressure fuel pump 100 and a second high-pressure fuel pump 200. Both high-pressure fuel pumps 100, 200 may be the same type of fuel pump. Accordingly, the basic structure of both fuel pumps 100, 200 may be identical. However, in other exemplary embodiments of a fuel injection system 5, the type or construction of fuel pumps 100, 200 can be different. Furthermore, according to the present disclosure, the number of fuel pumps 100, 200 is at least two. Depending on the internal combustion engine and its rated power output, it might be suitable to provide two or more fuel pumps of the same or different type.

Herein, the first high pressure fuel pump 100 includes a pumping element 115, which may include 2 to 4 or even more pistons guided in a piston guide (not shown). An intake section 110 may be disposed upstream of the pumping element 115. The intake section 110 may include a suction throttle valve or flow control valve 120. A return line 125 extends from the pumping element 115 to the intake section 110. Fuel at a low pressure is indicated with reference numeral 104. Fuel at a high pressure outputted from the high-pressure fuel pump 100 is indicated by reference numeral 105. Each fuel pump 100, 200 may be provided with an individual flow control valve 120, 220 or a single common flow control valve may be utilized to distribute fuel to two or more fuel pumps 100, 200.

The second high pressure fuel pump 200 may also include a pumping element 215, which may include 2 to 4 or even more pistons guided in a piston guide (not shown). An intake section 210 may be disposed upstream of the pumping element 215. The intake section 210 may include a flow control valve 220. A return line 225 extends from the pumping element 215 to the intake section 210. Fuel at a low pressure is indicated with reference numeral 204. Fuel at a high pressure outputted from the high-pressure fuel pump 200 is indicated by reference numeral 205.

Both high-pressure fuel pumps 100, 200 and the associated parts, in particular the flow control valves 120, 220, may be connected with a control unit 400, for example an ECM. In addition, both fuel pumps 100, 200 may be driven by the internal combustion engine 500 via, e.g., a mechanical coupling, such as a crankshaft coupling or a belt coupling, and/or a transmission. In addition or in the alternative, the first and second fuel pumps 100, 200 are preferably configured to output fuel at a pressure equal to or greater than 500 bar, more preferably 1000 bar and even more preferably 1500 bar or 1800 bar or 2000 bar or more.

Figure 2:
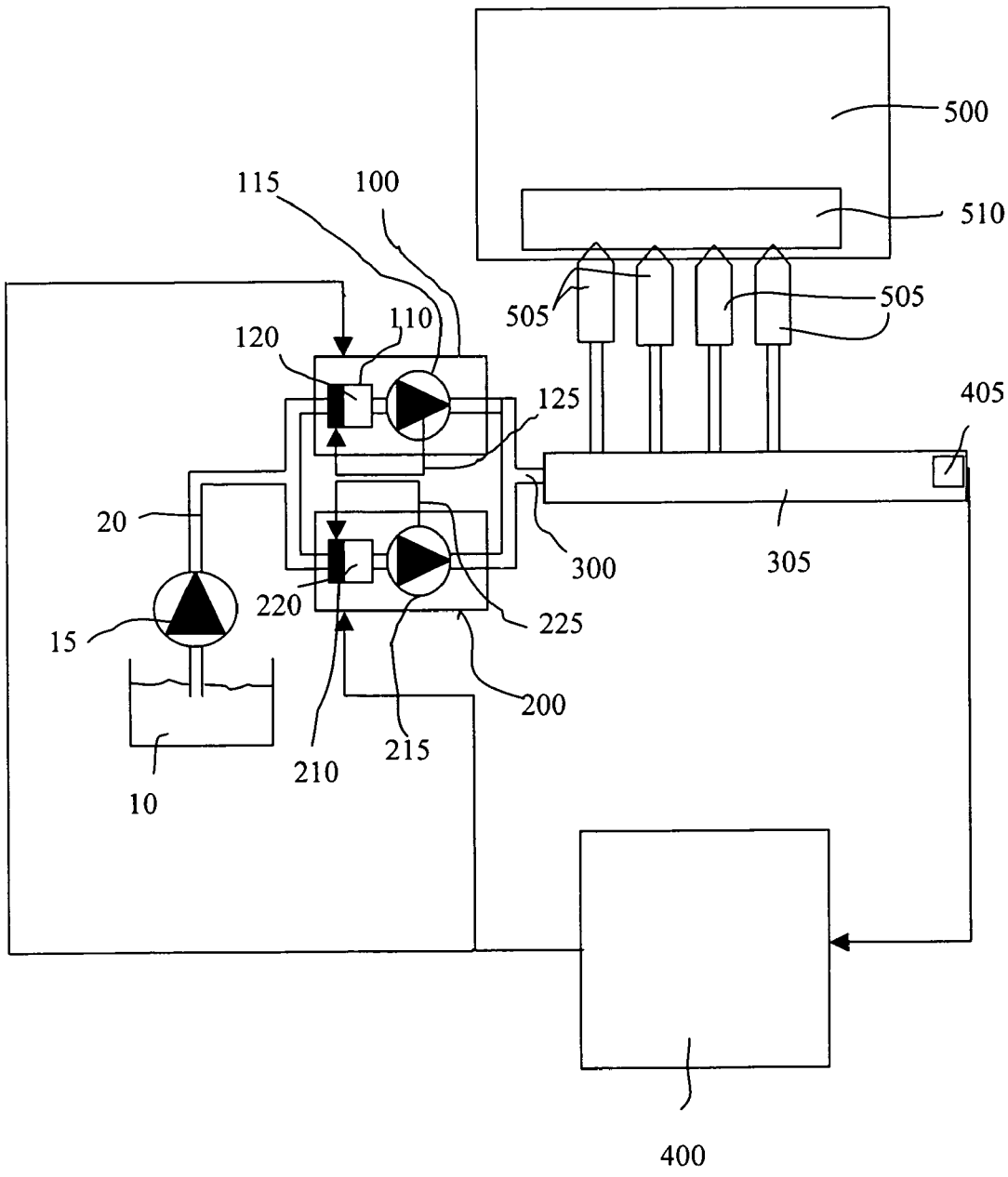
FIG. 2 is system diagram of a further exemplary embodiment of a fuel injection system comprising two high-pressure fuel pumps.

FIG. 2 shows a system diagram of a fuel injection system 5 incorporating the basic principle of the fuel injection system disclosed in FIG. 1. Herein, a low-pressure pump 15 is connected via a fuel supply line 20 with fuel intake sections 110, 210 of the high-pressure fuel pumps 100, 200. The pump 15 is connected with the fuel tank 10.

The high-pressure fuel distribution line system 300 may include a common rail 305. The common rail 305 in turn is connected with high-pressure fuel injection nozzles 505. The injection nozzles 505 discharge into one or more combustion chambers 510 of an internal combustion engine 500. As was mentioned with regard to FIG. 1, a control unit 400 is connected with the high-pressure pressure fuel pumps 100, 200 and, e.g., with the respective intake sections 110, 210. A pressure sensor 405 may be disposed in the common rail 305 and connected with the control unit 400.

INDUSTRIAL APPLICABILITY

The low-pressure fuel pump 15 pumps fuel 104, 204 at a low pressure from the fuel tank 10 via the fuel line 20 to the intake sections 110, 210 of the high-pressure fuel pumps 100, 200. The control unit 400 may adjust the flow control valves 120, 220 in such a manner that the pressure in the common rail 305 detected by the sensor 405 is increased, maintained or reduced to a value desired for an actual engine load of the internal combustion engine 500. The control unit 400 may control the flow control valves 120, 220 such that the amount of fuel pumped by both high-pressure fuel pumps 100, 200 into the high-pressure pressure distribution line system 300 is required for operation of the engine 500 at the desired actual load. The fuel 104, 204 passing through both flow control valves 120, 220 is pumped by the high-pressure fuel pumps 100, 200 to the desired high-pressure value and may flow into the high pressure distribution line system 300 and further into the common rail 305. From the common rail 305 the high-pressure fuel is injected into the combustion chamber 510 of the internal combustion engine 500.

Figure 3:
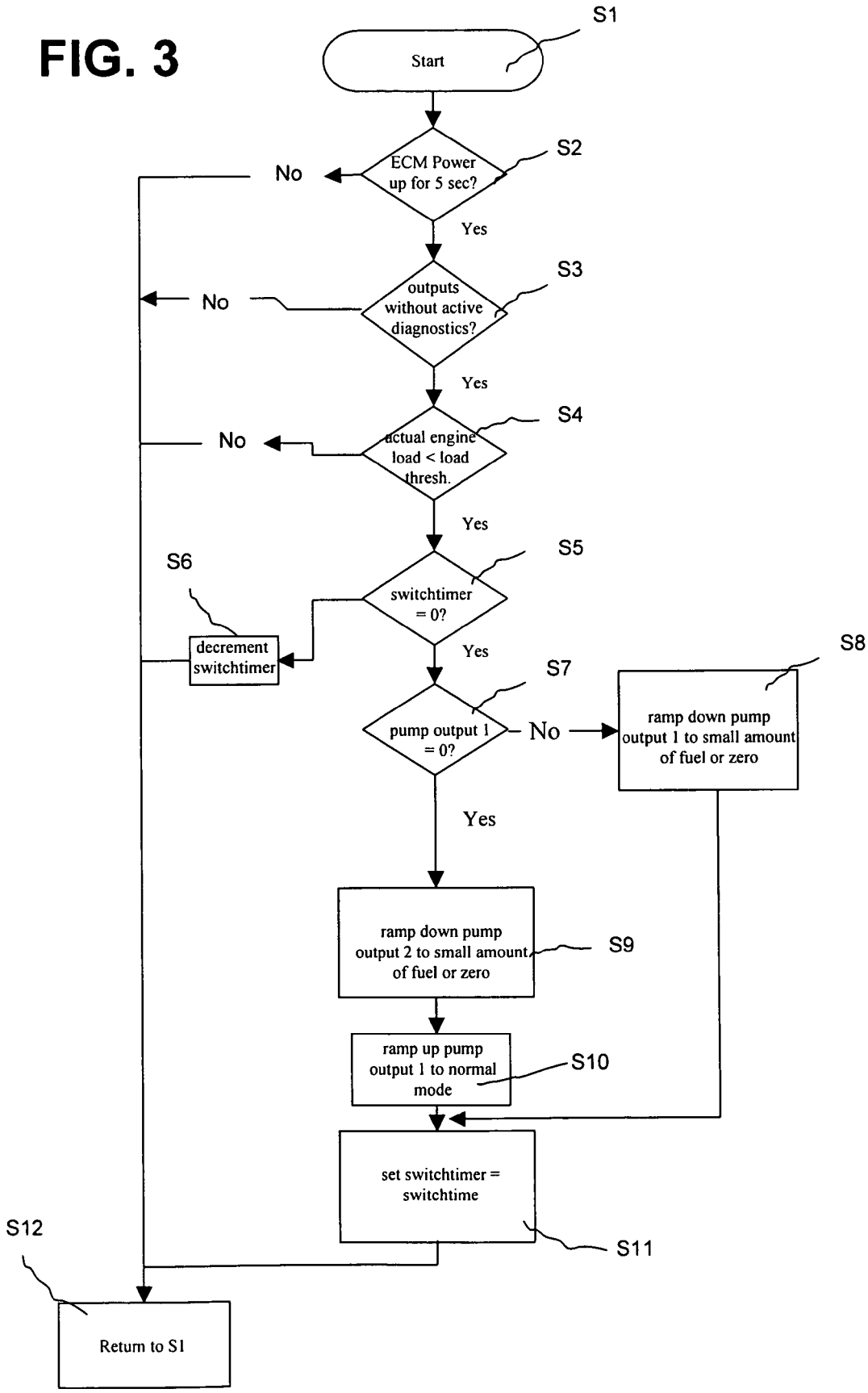
FIG. 3 is a flow chart of an exemplary embodiment of a method for controlling at least two high-pressure fuel pumps for pumping fuel at a high pressure into a high-pressure fuel distribution line system connected with an internal combustion engine.

Referring to FIG. 3, showing a flow chart of an exemplary embodiment of a disclosed method, a low-load pump switch control mode or routine will be explained in detail.

As outlined above, in case the engine load is higher than a predetermined load threshold, each of the two high-pressure fuel pumps 100, 200 pumps such a large amount of fuel 105, 205 that the temperature of the pumped mixture of new fuel 104, 204 supplied from the tank 10 and the recycled leaked fuel remains below a critical temperature despite the high temperature of the recycled leaked fuel. The predetermined load threshold may be about 5-10% or 1-20%, more particularly lower than 2% or 1%, even more particularly lower than 1% or 0.5% or less, of the maximum load of the internal combustion engine 500.

However, if the engine load is quite low, for example when the engine 500 is running at an idling speed, the relatively small amount of fuel being pumped in each high-pressure fuel pump 100, 200 may heat up. This heating is caused by the fact that the respective amount of fuel leaking from the pumping elements 115, 215 of the high-pressure fuel pump 100, 200 is relatively large in comparison with the amount of new fuel being supplied from the pump 15 and originating from the tank 10, which fuel is at a lower temperature.

Therefore, in step S1 a low-load pump switch control mode is started. The low-load pump switch control mode may correspond to the method disclosed above. In step S2, it may be checked whether the ECM power has been on for more than five seconds. This query is standard for ECMs to guarantee that the ECM 400 is operating correctly. In case the ECM 400 has not been powered for a sufficient period, e.g. less then, e.g., five seconds, the process proceeds to step S12. In step 12, the process returns to step S1.

In case it is determined in step S2 that the ECM 400 has already been powered for more than the sufficient period, e.g., five seconds, the process continues to step S3. In step S3 it is ensured that all electrical equipment is working correctly, e.g., it is checked whether the outputs are without active diagnostics. If all outputs are active, the process proceeds to step S4. Otherwise, the process proceeds to step S12.

In step S4, it is checked whether or not the actual engine load is below a predetermined load threshold. In case the actual load is below the threshold, the amount of fuel being pumped in each high-pressure fuel pump 100, 200 may be so small that the problem of heating up of parts of the pumping elements 110, 210 of each high-pressure fuel pump 100, 200 may arise.

If the actual engine load is below the load threshold, the process proceeds to step S5. In step S5, it is checked whether a switch timer or counter is equal to zero. If not, the counter is decremented in step 6. Then the process proceeds to steps S12 and S1. If the counter is already zero, the process proceeds to step S7. Here, it is checked whether the pump output of the first high-pressure fuel pump 100 (e.g. pump output 1 according to FIG. 3) is zero or a small amount of fuel (first amount of fuel) (In FIG. 3, "0" may mean zero or a small output). If the actual engine load was previously higher than the load threshold, the pump output of the first high-pressure fuel pump 100 is not zero or small. Therefore, the process proceeds to step S8.

In step S8, the pump output of the high-pressure fuel pump 100 (in FIG. 3, pump output 1) is ramped down to zero or to a small amount of fuel. This may mean that the flow control valve 120 of the first high-pressure fuel pump 100 will be gradually closed or nearly closed within a predetermined time period. Consequently, the amount of fuel being pumped by the pumping element 115 of the first high-pressure fuel pump 100 is about zero or is only a small amount of fuel (for example corresponding to the fuel leaked from the pumping element 115). Then, the process proceeds to method step S11.

In step S11, the counter is set, i.e. the first time period starts now. Then, the process proceeds to method step S12 and in turn to step S1. Again, in method step S5 it is checked whether the counter is zero or not. Due to the fact that the counter was started in step S11, the counter is not zero when step S5 is reached again. Therefore, the process proceeds to step S6. The cycle including the method steps S1 to S5 and S6 continues until the counter again becomes zero, i.e. the first time period is finished.

After the first time period, the process proceeds to method step S7. Due to the fact that the pump output of the first high-pressure fuel pump 100 is currently zero or small, the process proceeds to method step S9. Accordingly, the pump output of the second high-pressure fuel pump 200 (in FIG. 3 pump output 2) is ramped down to zero or to a small amount of fuel. In one exemplary embodiment, the ramping function for the second fuel pump 200 can be the same as the ramping function of the first high-pressure fuel pump 100. In another exemplary embodiment, the ramp-down function may be different.

Then, the process proceeds to method step S10. Accordingly, the pump output of the first high-pressure fuel pump 100 (in FIG. 3, pump output 1) is ramped up such that the second amount of fuel is pumped by the high-pressure fuel pump 100 to operate the internal combustion engine 500 at the desired low load (e.g., idling mode). Thereafter, in method step S11, the counter may be set again to a preset switch time period (in FIG. 3 switch time), e.g., the time period after one or more pumps are switched from one mode into another mode.

Thereafter, the method steps S1 to S5 and S6 continue to run until the second time period has finished. Then, in method step S8, the pump output of the high-pressure pump 100 (in FIG. 3 pump output 1) is ramped down again.

The switching between the two pump modes of the two high-pressure pressure fuel pumps 100, 200 in accordance to the above-mentioned cycle, including method steps S1-S12, is active as long as the actual engine load is lower than the predetermined load threshold. Otherwise, the two high-pressure fuel pumps 100, 200 operate and pump so as to operate the internal combustion engine 500 at the desired load, i.e., for example the flow control valves 120, 220 are controlled, such that the associated high-pressure fuel pumps 100, 200 pump altogether a total amount of fuel corresponding to the actual load.

The above method also may be applied to more than two high-pressure pressure fuel pumps 100, 200. In this case, at least one of the total number of high-pressure fuel pumps 100, 200 operates in the first pump mode and at least one of the other fuel pumps 100, 200 operates in the second pump mode. In an exemplary embodiment, all other high-pressure fuel pump(s) 100, 200 will run in the second pump mode except the high-pressure fuel pumps running in the first pump mode.

Figure 4:
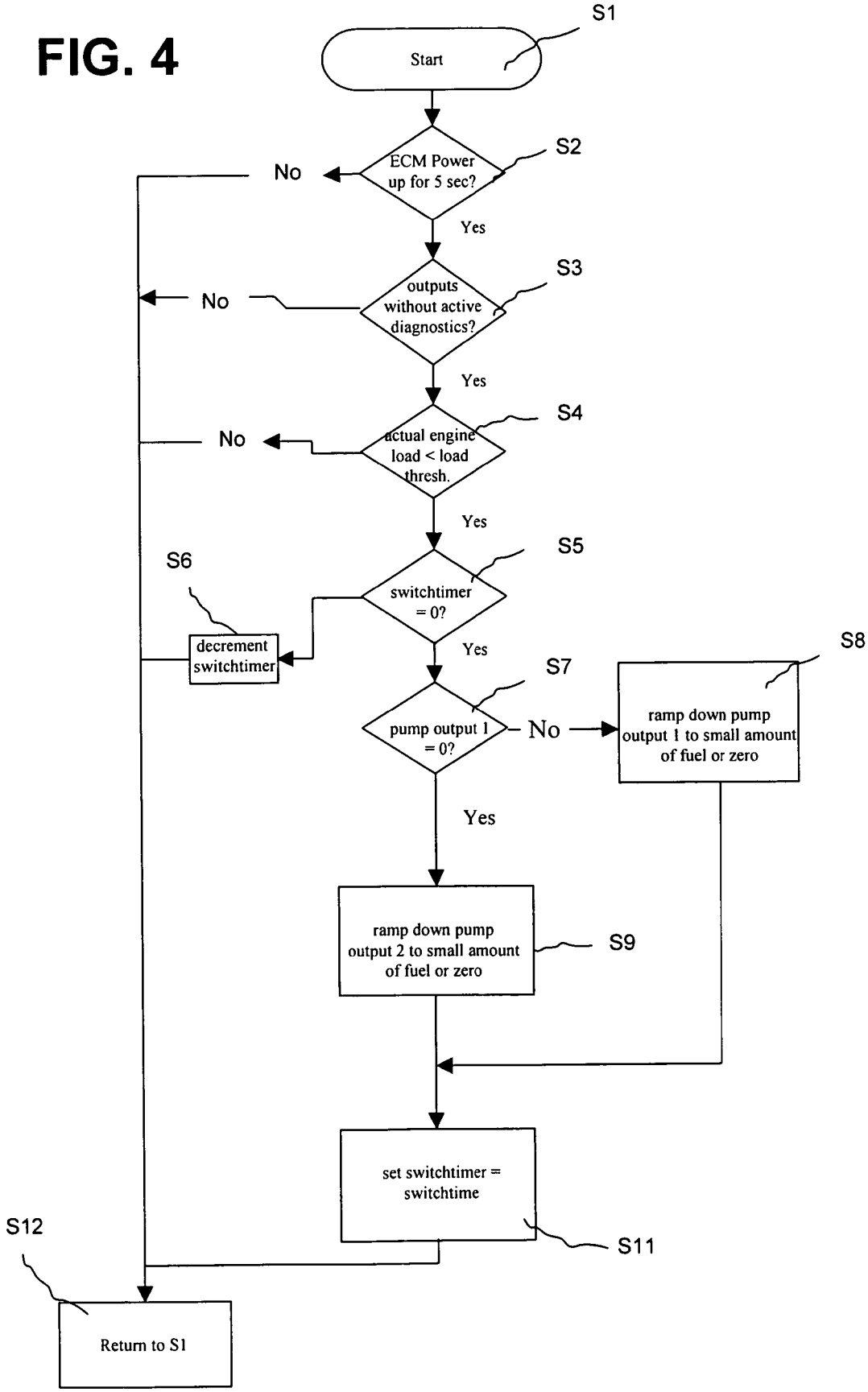
FIG. 4 is a flow chart of another exemplary embodiment of a method for controlling at least two high-pressure fuel pumps for pumping fuel at a high pressure into a high-pressure fuel distribution line system connected with an internal combustion engine.

The flow diagram shown in FIG. 4 is identical with the flow diagram shown in FIG. 3 except that method step S10 is omitted. In this exemplary embodiment, for example a controller 400 as, e.g., a PID controller (proportional-integral-derivative controller) or a pressure controller operates the flow control valves 120, 220 in real time based on the pressure in the common rail 305 detected by the pressure sensor 405. The controller 400 may be a commonly-available control loop feedback mechanism available for industrial control systems. The controller 400 may attempt to correct any deviation between a measured process variable and a desired setpoint by calculating and then outputting a corrective value that can adjust the process accordingly. Here, the process variable may be the pressure in the common rail 405. This process control of the flow control valves 120, 220 may be temporarily suspended for one of the two high-pressure fuel pumps 100, 200 by the method described above and shown in FIG. 4.

According to the process shown in FIG. 4, in step S8 the flow control valve 120 of the first high-pressure fuel pump 100 is adjusted such that no fuel or only a small amount of fuel can pass and be pumped by the pumping element 115. Due to the process control, the other flow control valve 220 of the second high-pressure fuel pump 200 is automatically adjusted by the controller such that more fuel will be pumped via the second high-pressure fuel pump 200 in order to maintain the desired pressure in the common rail 305. As long as the pump output 1 of the first high-pressure fuel pump 100 in accordance with the steps S2-S6 is zero or very low and does not change, the second high-pressure fuel pump 200 is controlled in accordance with the PID process control. In an exemplary embodiment of the present disclosure the process control may be a PID process control.

As soon as the flow control valve 220 of the second high-pressure fuel pump 200 is actively reduced according to step S9, the first flow control valve of the first high-pressure fuel pump 100 is again controlled in accordance with the process control, e.g. the PID process control. The process shown in FIG. 4 illustrates that, according to this exemplary embodiment of the present disclosure, the flow control valves 120, 220 are integrated in a process control, preferably a PID process control. However, in case the actual engine load is lower than the engine threshold, alternately one of the two flow control valves 120, 220 is actively adjusted for the first or second time period such that zero or a small amount of fuel passes therethrough.

Finally, it is to be noted that the expression "first amount of fuel" may mean that e.g. 30%, or 20% or 10% or 5% or 1% or 0.5% or 0.1% or 0.01% or 0.001% or less of the maximum amount of fuel pumped by the high-pressure fuel pump 100, 200 passes through the corresponding flow control valve 120, 220. All intermediate percentage between about 30% and 0.0% are expressly included in this disclosure.

In addition, the first amount of fuel may be any percentage between about 30% to 0% of the second amount of fuel.

It is to be noted that the expression "amount of fuel" used above may be replaced by the expression "rate of fuel". Accordingly, the expression "first amount of fuel" may be replaced by "first rate of fuel" and "second amount of fuel" may be replaced by "second rate of fuel". The expression "amount of fuel" may mean an absolute volume of fuel, e.g. 4 ml. The expression "rate of fuel" may mean volume/time, e.g., 4 ml/s.

In one disclosed embodiment, in case an actual engine load is below a set load threshold, the fuel pumps may be operated in a low load pump switch control mode. Accordingly, a high-pressure fuel pump may heat up during operation in the first pump mode and a high-pressure fuel pump may heat up less or even cool down during operation in the second pump mode. Due to the switching of the high-pressure fuel pumps between the first and second pump modes, the average temperature of the high-pressure fuel pumps might be higher than when the high-pressure fuel pumps are operated with large flow rates, but all high-pressure fuel pumps may nevertheless remain in tolerable temperature ranges even during idling.

An advantage of certain preferred embodiments may be that the basic arrangement of the fuel injection system is not required to be changed. A control unit may be easily modified without undue efforts and, hence, with relatively low costs.

Figure 5:
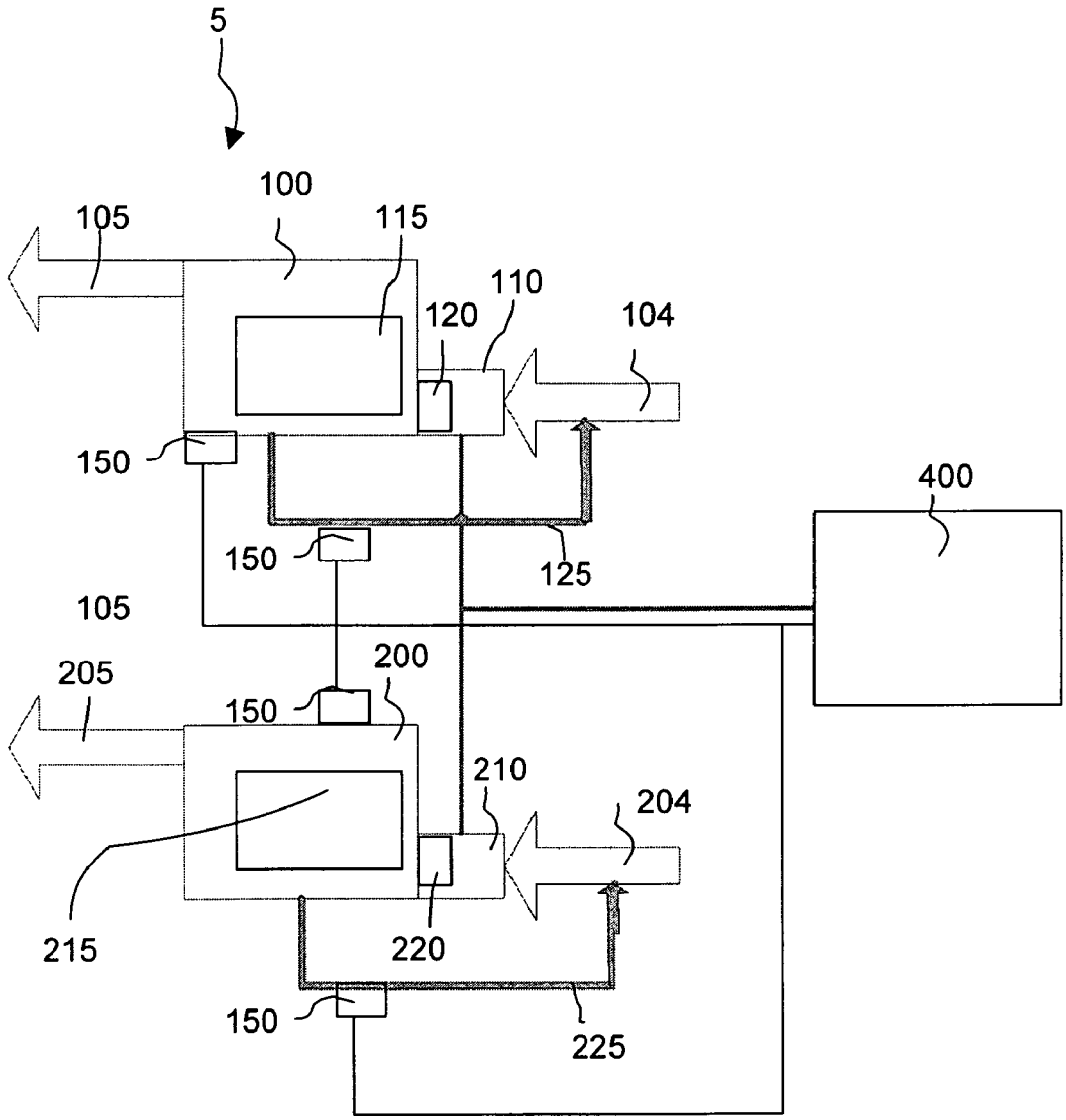
FIG. 5 shows a modification of the embodiment of FIG. 1, which includes temperature sensors on the pumps and fuel return lines.

The above-described system may be controlled by looking at the load on the engine. Alternatively, the system may be controlled by measuring temperatures, e.g., the temperature of one or more pumps and/or the temperature of one or more fuel return lines. An example of this embodiment is shown in FIG. 5, which is a modification of the embodiment of FIG. 1, such that it is not necessary to describe common elements. In this embodiment, temperature information concerning one or both of one or more pumps or one or more fuel return lines may be generated by one or more temperature sensors 150 and temperature information may be communicated to the control unit 400. The control unit 400 may then utilize this temperature information to determine when to switch or change the operating modes of the flow control valves 120, 220 and/or the pumps 100, 200. For example, if the temperature of fuel pump 100 and/or fuel return line 125 exceeds a predetermined temperature threshold, due to the pump 100 being operated in a mode where it pumps little or no fuel, the control unit 400 may switch the operation of the pumps 100, 200, such that pump 100 pumps a greater amount of fuel, thereby cooling down pump 100, and pump 200 pumps little or no fuel. In addition or in the alternative, the control unit 400 may cause flow control valve 120 to open and permit more fuel to pass therethrough, when it is determined that pump 100 and/or fuel return line 125 has exceed a predetermined temperature threshold. Likewise, if control unit 400 determines that pump 200 and/or fuel return line 225 has exceeded a predetermined temperature limit, then control unit 400 may cause flow control valve 220 to open and/or permit more fuel to pass therethrough, so that pump 200 is cooled down.

Finally, the basic idea of the present disclosure may be seen in alternately operating at least two high-pressure fuel pumps if a small amount of fuel is requested by the internal combustion engine, e.g. when the internal combustion engine as, e.g., a large diesel engine, is idling or has a low load. If the first pump receives a minimum amount of fuel, e.g. by adjusting a control valve associated to the first pump so that the smallest passage in that control valve is achieved, the first pump may heat up. The second pump pumps simultaneously the (low) amount of fuel necessary for operating the engine at the desired load. Accordingly, the second pump may cool down. After a defined time period (or if the temperature of the first pump reaches a defined level), the operation of the two pumps is switched. Now, the first pump pumps the (low) amount of fuel necessary for operating the engine at the desired load. Consequently, the first pump may cool down. The second pump pumps simultaneously a minimum amount of fuel and may heat up. Due to this alternately pump modes both pumps may heat up and cool down without reaching a critical temperature level.

It has to be noted that the present disclosure refers both to a closed loop control operation and a simple control. If for example the pumps pump an amount of fuel that is higher than requested by the injectors of the engine, a valve in the common rail may open to control the pressure of the fuel.

Although the preferred embodiments of this invention have been described herein, improvements and modifications may be incorporated without departing from the scope of the following claims.

The invention claimed is:

1. A fuel injection system, comprising:

at least two high-pressure fuel pumps, each high-pressure fuel pump being configured to pump fuel at a high pressure into a high-pressure fuel distribution line system fluidly communicating with an internal combustion engine, wherein each of the high-pressure fuel pumps is configured to be operated in a first supply pump mode and a second pump supply mode, such that in the first pump supply mode a first amount of fuel is pumped, and in the second pump supply mode a second amount of fuel is pumped, said second amount of fuel being greater than the first amount of fuel, wherein the total amount of fuel simultaneously pumped by all high-pressure fuel pumps corresponds to an amount of fuel that is necessary to operate the internal combustion engine at a predetermined engine load, and a control unit configured to alternately operate the high-pressure fuel pumps such that, during a first time period at least one of the high-pressure fuel pumps is operated in the first pump supply mode and one or more other high-pressure fuel pumps is simultaneously operated in the second pump supply mode, and such that during a second time period at least one high-pressure fuel pump operated during the first time period in the second pump supply mode is operated in the first pump supply mode and one or more other high-pressure fuel pumps is simultaneously operated in the second pump supply mode.

2. The fuel injection system according to claim 1, wherein the high-pressure fuel pumps are configured to be mechanically driven, directly or indirectly, by the internal combustion engine, and the high-pressure fuel pumps are configured to operate in parallel to pump fuel supplied from a fuel reservoir to a common rail of the high-pressure fuel distribution line system.

3. The fuel injection system according to claim 1, wherein each high-pressure fuel pump includes a fuel intake section, a high-pressure pumping element disposed downstream of the fuel intake section, and a fuel return line arranged to return fuel leaked between the pumping element and a pumping element guide to the associated fuel intake section.

4. The fuel injection system according to claim 1, further including a flow control valve disposed between a fuel reservoir and each respective high-pressure pump, all control valves being controllable by the control unit to switch between the first and second pump supply modes.

5. The fuel injection system according to claim 4, wherein each flow control valve is adjustable to regulate the amount of fuel flowing into the high-pressure fuel pump, to which the respective flow control valve is coupled.

6. The fuel injection system according to claim 4, wherein the control unit is configured to operate the flow control valve of at least one high-pressure fuel pump in the first pump supply mode such that the first amount of fuel passes from the associated fuel intake section to the associated pumping element, and the control unit is configured to operate the flow control valve of one or more other high-pressure fuel pumps in the second pump supply mode such that the second amount of fuel passes from the associated fuel intake sections to the associated pumping elements, wherein the total amount of fuel pumped by all high-pressure pumps corresponds to the amount of fuel required to operate the internal combustion engine at the desired engine load.

7. The fuel injection system according to claim 4, wherein the high-pressure fuel distribution line system includes a common rail and a pressure sensor configured to detect the fuel pressure in the common rail, wherein the pressure sensor communicates with the control unit and the control unit controls the flow control valves in accordance with the fuel pressure detected by the pressure sensor.

8. The fuel injection system according to claim 1, wherein the control unit is configured to alternately operate the high-pressure fuel pumps in the first and second pump supply modes when an actual load of the internal combustion engine is below a predetermined load threshold.

9. The fuel injection system according to claim 1, wherein the control unit comprises a controller configured to operate the flow control valves so as to adjust the flow control valves in accordance with at least one of a fuel pressure detected in a common rail of the high-pressure fuel distribution line system and a temperature detected in association with one of the high-pressure fuel pumps.

10. The fuel injection system according to claim 1, wherein:

each high-pressure fuel pump includes a fuel intake section, a high-pressure pumping element disposed downstream of the fuel intake section and a fuel return line arranged to return fuel, which was leaked between the pumping element and a pumping element guide, to the associated fuel intake section, a flow control valve is disposed between a fuel reservoir and each respective high-pressure pump, all control valves being controllable by the control unit to switch between the first and second pump supply modes to regulate the amount of fuel flowing into the high-pressure fuel pump, to which the respective flow control valve is coupled, the control unit is configured to operate the flow control valve of at least one high-pressure fuel pump in the first pump supply mode such that the first amount of fuel passes from the associated fuel intake section to the associated pumping element, and the control unit is configured to operate the flow control valve of one or more other high-pressure fuel pumps in the second supply pump mode such that the second amount of fuel passes from the associated fuel intake sections to the associated pumping elements, wherein the total amount of fuel pumped by all high-pressure pumps corresponds to the amount of fuel required to operate the internal combustion engine at the desired engine load, and the control unit is configured to control the flow control valves in accordance with a fuel pressure detected by a pressure sensor in association with the high-pressure fuel distribution line system and/or a temperature detected by a temperature sensor in association with at least one high-pressure fuel pump.

11. The fuel injection system according to claim 10, wherein the control unit is configured to alternately operate the high-pressure fuel pumps in the first and second pump supply modes when an actual load of the internal combustion engine is at or below a predetermined load threshold.

12. The fuel injection system according to claim 11, wherein the predetermined load threshold represents an engine idling state.

13. A method for controlling at least two high-pressure fuel pumps configured to supply high-pressure fuel in parallel from a fuel reservoir to a common rail fluidly communicating with an internal combustion engine, the method comprising:

operating for a first time period at least one of said high-pressure fuel pumps in a first pump supply mode and simultaneously operating one or more other high-pressure fuel pumps in a second pump supply mode, wherein a greater amount of fuel is pumped by each high-pressure pump in the second pump supply mode than in the first pump supply mode, and subsequently operating for a second time period at least one of the high-pressure fuel pumps, which was operated during the first time period in the second pump supply mode, in the first pump supply mode and simultaneously operating one or more other high-pressure fuel pumps in the second pump supply mode, and wherein in the first time period and in the second time period the total amount of fuel simultaneously pumped by all high-pressure fuel pumps corresponds to an amount of fuel that is necessary to operate the internal combustion engine at or below a predetermined engine load.

14. The method according to claim 13, wherein the high-pressure fuel pumps are mechanically driven by the internal combustion engine and/or electronically controlled, the method further comprising:

operating the high-pressure fuel pumps in the first and second pump supply modes, respectively, only when an actual load of the internal combustion engine is equal to or below a predetermined load threshold.

15. The method according to claim 13, wherein the total number of high-pressure fuel pumps operating simultaneously in the first pump supply mode is equal to or less than the total number of high-pressure fuel pumps operating within the same time period in the second pump supply mode.

16. The method according to claim 13, wherein each of the high-pressure fuel pumps includes a flow control valve disposed downstream of an associated fuel intake section and disposed upstream of an associated high-pressure pumping element, the flow control valves being configured to regulate the amount of fuel passing from the associated fuel intake section to the associated pumping element, and the method further comprises:

adjusting the flow control valves to alternately operate the high-pressure fuel pumps in the first pump supply mode and the second pump supply mode.

17. The method according to claim 16, wherein the flow control valves are operated in accordance with a control process that has as an input least one of a fuel pressure detected in the common rail and a temperature detected in association with one of the high-pressure fuel pumps.

18. A computer-readable medium having a computer program stored thereon, wherein the computer program includes processor-executable instructions that, when executed, cause a processor to perform the method steps of claim 13.

19. A control unit for a fuel injection system and configured to control an amount of high-pressure fuel supplied to an internal combustion engine, wherein the fuel injection system comprises at least two high-pressure fuel pumps configured to pump fuel at a high pressure into a high-pressure fuel distribution line system fluidly communicating with the internal combustion engine, each of the high-pressure fuel pumps being configured to be operated in a first pump supply mode and a second pump supply mode, such that in the first pump supply mode a first amount of fuel is pumped by the respective high pressure fuel pump, and in the second pump supply mode a second amount of fuel is pumped by the respective high pressure fuel pump, wherein:

the control unit is configured to alternately operate the high-pressure fuel pumps when the internal combustion engine is to be operated at or below a predetermined engine load such that, during a first time period at least one of the high-pressure fuel pumps is operated in the first pump supply mode and one or more other high-pressure fuel pumps is simultaneously operated in the second pump supply mode, and such that during a second time period at least one of the high-pressure fuel pumps operated during the first time period in the second pump supply mode is operated in the first pump supply mode and one or more other high-pressure fuel pumps is simultaneously operated in the second pump supply mode.

20. A fuel injection system comprising:

at least two high-pressure fuel pumps configured to operate in parallel to pump fuel supplied from a fuel reservoir to a common rail configured to supply high-pressure fuel to a plurality of fuel injectors of an internal combustion engine, a flow control valve associated with each high-pressure fuel pump and configured to adjust an amount of fuel supplied from the fuel reservoir to the respective high-pressure fuel pump, and a control unit configured to control the operation of the flow control valves such that, when an actual load of the internal combustion engine is at or below a predetermined load threshold, the high-pressure fuel pumps are individually operated alternatively in a first supply mode for a first time period and a second supply mode for a second time period, wherein in the first supply mode at least one high-pressure fuel pump receives a low or no amount of fuel supplied from the fuel reservoir while one or more other high-pressure fuel pumps receive(s) a relatively larger amount of fuel supplied from the fuel reservoir, and wherein in the second supply mode at least one of the high-pressure fuel pumps operated in the first time period in the second mode receives a low or no amount of fuel supplied from the fuel reservoir while one or more other high-pressure fuel pumps receive(s) a relatively larger amount of fuel supplied from the fuel reservoir.

21. The fuel injection system according to claim 20, wherein the predetermined load threshold corresponds to an engine idling mode.

22. The fuel injection system according to claim 20, further comprising at least one temperature sensor thermally connected to at least one of at least high-pressure fuel pump and at least one fuel return line that fluidly communicates fuel, which was leaked between a piston and a piston guide of the high-pressure fuel pump, to an intake section of the high-pressure fuel pump, the temperature sensor being configured to electrically communicate temperature information to the control unit, wherein the control unit is configured to change from the first supply mode to the second supply mode when the temperature detected by the at least one temperature sensor exceeds a predetermined temperature.

23. A method for controlling the amount of fuel pumped by at least two high-pressure fuel pumps operating in parallel to pump fuel supplied from a fuel reservoir to a common rail configured to supply fuel to a plurality of fuel injectors of an internal combustion engine, wherein a flow control valve is in fluid communication with each high-pressure fuel pump and each flow control valve is configured to supply fuel from the fuel reservoir to the respective high-pressure fuel pump, the method comprising:

determining when an actual load of the internal combustion engine is at or below a predetermined load threshold, in response to a determination that the actual load is at or below a predetermined load threshold, adjusting the flow control valves to alternately operate the high-pressure fuel pumps in a first supply mode and a second supply mode, wherein in the first supply mode at least one high-pressure fuel pump receives a low or no amount of fuel supplied from the fuel reservoir while one or more other high-pressure fuel pumps receive(s) a relatively larger amount of fuel supplied from the fuel reservoir, and wherein in the second supply mode at least one of the high-pressure fuel pumps previously operated in the second mode receives a low or no amount of fuel supplied from the fuel reservoir while one or more other high-pressure fuel pumps receive(s) a relatively larger amount of fuel supplied from the fuel reservoir.

24. The method according to claim 23, further comprising:

detecting a temperature of at least one high-pressure fuel pump, at least one fuel return line associated with the respective high-pressure fuel pump and/or fuel flowing in at least one fuel return line, and changing from the first supply mode to the second supply mode when at least one detected temperature exceeds a predetermined temperature.

25. A computer-readable medium having a computer program stored thereon, wherein the computer program includes processor-executable instructions that, when executed, cause a processor to perform the method steps of claim 23.

* * * * *